US007185763B2

(12) United States Patent
Ali

(10) Patent No.: US 7,185,763 B2
(45) Date of Patent: Mar. 6, 2007

(54) CUPHOLDING LAP TRAY

(76) Inventor: Waiel Ali, 7912 Borla Pl., Carlsbad, CA (US) 02889

( * ) Notice: Subject to any disclaimer, the term of this patent is extended or adjusted under 35 U.S.C. 154(b) by 0 days.

(21) Appl. No.: 10/965,042

(22) Filed: Oct. 12, 2004

(65) Prior Publication Data

US 2006/0076469 A1 Apr. 13, 2006

(51) Int. Cl.
*B65D 1/34* (2006.01)
*B65D 6/04* (2006.01)

(52) U.S. Cl. ..... 206/561; 206/564; 220/556; 220/575

(58) Field of Classification Search ..... 206/561–565; 248/311.2; 220/556, 563, 575
See application file for complete search history.

(56) References Cited

U.S. PATENT DOCUMENTS 2,851,154 A * 9/1958 Dingeldein ..... 206/19
3,638,849 A * 2/1972 Goings ..... 229/406
3,768,710 A * 10/1973 Eggers ..... 294/159
5,118,063 A * 6/1992 Young, Sr. ..... 248/311.2
5,421,459 A * 6/1995 Mazzotti ..... 206/549
5,915,561 A * 6/1999 Lorenzana et al. ..... 206/562
5,971,139 A * 10/1999 Bradley ..... 206/217
RE37,239 E * 6/2001 Eisenberg ..... 108/43
6,264,026 B1 * 7/2001 Bradley ..... 206/217
6,290,063 B1 * 9/2001 Vogt et al. ..... 206/549
6,732,990 B2 * 5/2004 Hudson ..... 248/311.2
2003/0168565 A1 * 9/2003 Casiello, Jr. ..... 248/346.11

* cited by examiner

*Primary Examiner*—Amy J. Sterling
(74) *Attorney, Agent, or Firm*—Charmasson, Buchaca & Leach, LLP

(57) ABSTRACT

A lap tray to securely hold finger food and a beverage cup on one's lap while parked in a vehicle or watching a spectacle either at home, at a movie theater, or in a stadium. The cup receptacle consists of a well positioned at the center of gravity of the tray. The well extends below the lower surface of the tray to fit between the thighs, and also provides, in cooperation with some undersurface fins, a convenient way to grab and carry the tray with one hand. The top surface area surrounding the well is slanted toward it. The ribs project into the cupholding well to keep the cup at a slight distance from the wall and bottom so that any spillage is drained to a reservoir area formed at the bottom of the well. A central depression in the front edge of the tray provides some clearance for a steering wheel. Slots provide for holding common eating utensils and the attachment of a carry strap.

11 Claims, 2 Drawing Sheets

CUPHOLDING LAP TRAY

FIELD OF THE INVENTION

This invention relates to carrying trays and more specifically to trays designed to rest on the lap of the user.

BACKGROUND OF THE INVENTION

It is not uncommon for a person to eat a meal while sitting away from a table such as when watching a spectacle either at home on television, at a movie theater, stadium, or even when in a vehicle such as an automobile. Various lap trays have been provided as part of the packaging of so-called "TV dinners" and for the convenience of bedridden persons.

Such a lap tray, improved by the addition of a cupholder, is disclosed in my earlier U.S. Pat. No. Des. 314,678.

The instant invention results from an intent to improve the stability of lap tray in general, and to provide a convenient means to carry the tray with a single hand.

SUMMARY OF THE INVENTION

The principal and secondary object of the invention are to provide a lap tray that can conveniently be used to hold finger food as well as a cup of beverage, and can be securely held over a person's lap while keeping any spilled beverage from running into the food-holding area or wetting the bottom of the beverage cup. It is also an object of the invention to provide a lap tray that can conveniently be held with one hand.

This and other valuable objects are achieved by a tray that provides two shallow depressions astride of a central zone that features a cupholding well. The walls of the well project under the tray between the thighs of the user for improved stability. The projecting well provides a convenient way to grab and carry the tray with one hand. The stability of the tray is further enhanced by a pair of fins projecting from the undersurface of the tray and extending radially from the well in order to provide convenient resting surfaces for the thumb and index finger of the person carrying the device. Slots are provided for holding utensils and to facilitate securing an optional carry strap.

DESCRIPTION OF THE PREFERRED EMBODIMENT OF THE INVENTION

Figure 1:
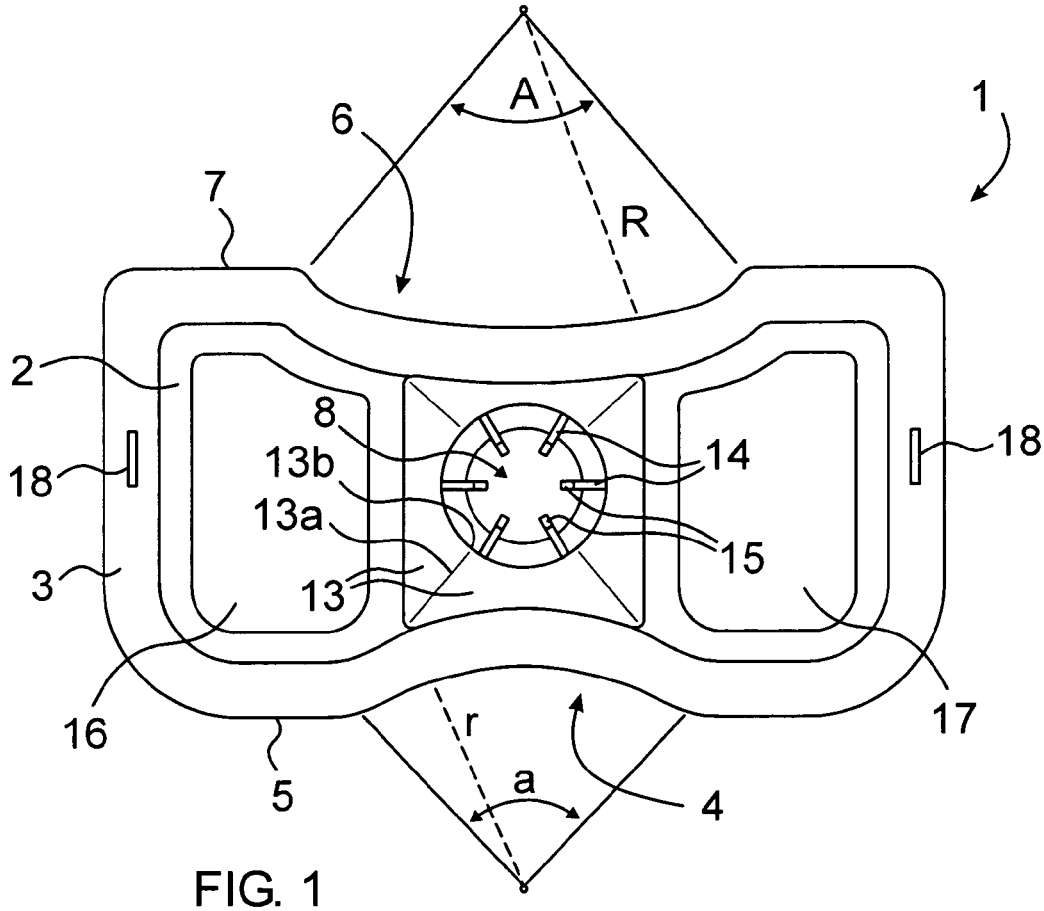
FIG. 1 is a top plan view of the lap tray according to the invention.
Figure 2:
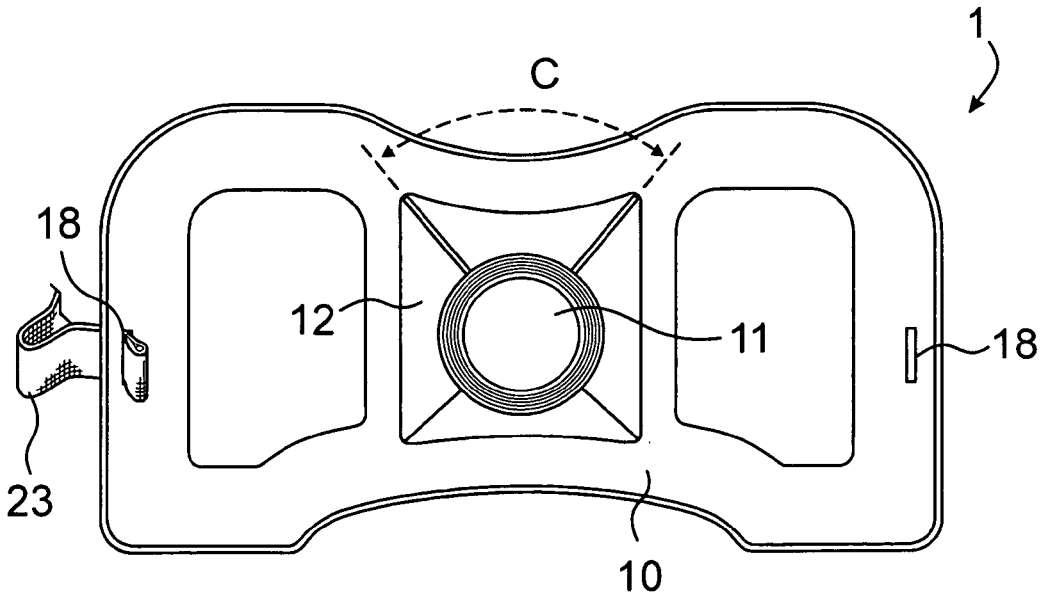
FIG. 2 is a bottom plan view thereof.
Figure 3:
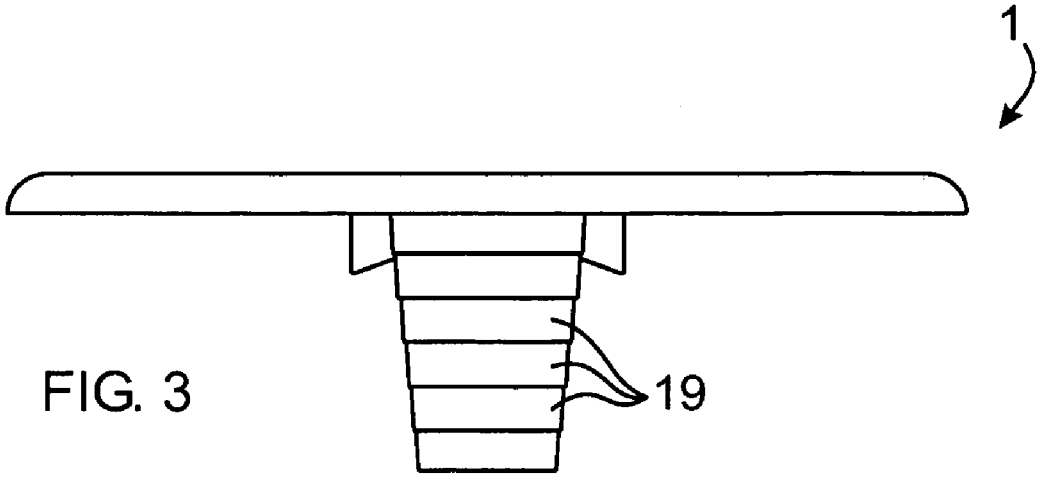
FIG. 3 is a front elevational view thereof.
Figure 4:
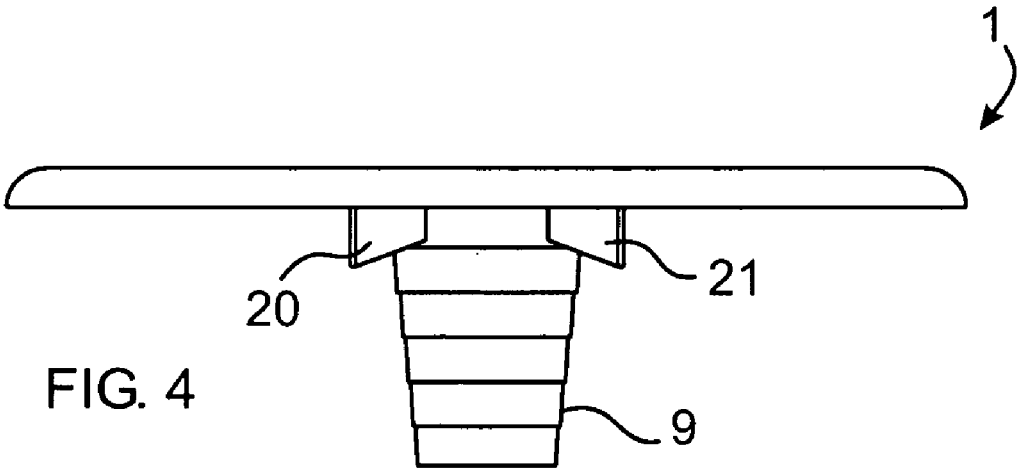
FIG. 4 is a back elevational view thereof.
Figure 5:
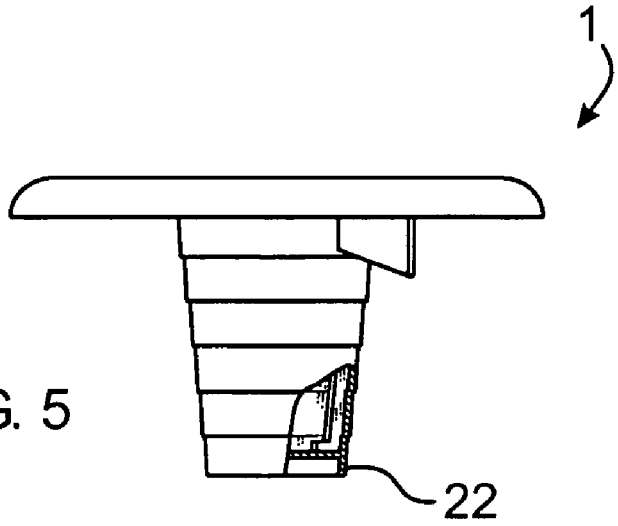
FIG. 5 is a side elevational view thereof.

Referring now to the drawing, there is shown a lap tray 1 that comprises a substantially rectangular platen 2 having a side-to-side length of approximately 45 centimeters (18 inches), and a front-to-back width of approximately 25 centimeters (10 inches). The entire device is entirely molded in a single piece out of polypropylene or other plastic material. The platen is stiffened by a raised peripheral border 3. A first horizontally recessed zone 4 in the center of the front edge 5 is intended to accommodate an arc portion of a vehicle steering wheel of approximately 60 degrees. Accordingly, the recessed zone has a radius r of approximately 15 centimeters (6 inches) and extends over an arc a of approximately 45 degrees. A second arcuate horizontally recessed zone 6 is formed in a central portion of the back edge 7 of the platen in order to accommodate the rotundity of the user's belly. This second recessed zone has a radius R of approximately 17 centimeters (6.7 inches), and extends over an arc A of approximately 45 degrees.

A well 8 positioned at the center of gravity of the tray is shaped and dimensioned to receive a beverage cup. The frustoconical wall 9 of the well extends downwardly from the undersurface 10 of the platen to a circular, closed bottom 11 having a diameter of about 6 centimeters (2.4 inches). The opening of the well at the upper surface of the platen having a diameter of about 4 centimeters (4 inches) is surrounded by a central zone 12 defining four upper surface segments 13 slanted toward the well. Each adjacent pair of segments join along a groove 13*a* slanted toward the well 8. Extending from the inside surface of the well wall radially toward the center and axially along the full depth of the well are a series of ribs 14 which prevent the walls of the cup inserted therein from contacting the wall of the well. The ribs are prolonged by stand-off projection 15 that rise from the bottom of the well. The groove 13*a* terminates at a location 13*b* spaced apart from any of the ribs. Accordingly, any beverage spilling from the cup over the central zone 12 is drained into the well, running against the wall of the well without contacting the cup, and accumulates in the reservoir caused by the stand-off projections at the bottom of the well below the bottom of the cup. The shallow recessed areas 16, 17 astride the central zone 12 provide two dish-shaped areas for holding food items. A pair of slots 18 extend through from the top surface to the undersurface of the tray. The slots are sized to allow the passage of common eating utensil handles without allowing passage of the widened head portion such as the scoop portion of a spoon or the tine portion of a fork, thereby acting as a utensil holder. The slots can also be sized to allow passage and anchorment of a holding or carrying strap 23.

The outside surface of the well forms a series of rings 19 of progressively decreasing radii in order to provide a rough texturing that increases the friction with an owner's hand. A pair of fins 20, 21 extending downwardly from the undersurface of the platen and projecting radially from the well over an arc C of approximately 45 degrees are shaped and dimensioned to provide convenient resting surfaces for the thumb and index of the hand holding the tray.

A circular flange 22 projects downwardly from the outer bottom surface of the well. This flange forms a ring-shaped footprint when the tray is rested on a horizontal surface, and minimizes the risk of the tray being tilted and upset by small objects resting on the surface.

While the preferred embodiment of the invention has been disclosed, modification can be made without departing from the scope of the appended claims.

What is claimed is:

1. A lap tray which comprises:

a platen having a top surface, an undersurface, a raised peripheral border, and a central area;

a well formed in said central area has a circular opening of a given diameter in said area, and includes a wall projecting from said undersurface, and a circular bottom of a lesser diameter than said given diameter;

said well being sized to accept and hold a beverage cup;

a plurality of internal ribs extending radially and axially from said wall;

a plurality of stand-off projections extending internally from said bottom;

whereby a cup inserted into said well is prevented from contacting the internal surfaces of said wall and bottom; and, wherein said central area comprises a plurality of slanted surface segments surrounding and slanted toward said well, wherein a pair of adjacent ones of said segments join along a groove slanted toward said well, wherein said groove terminates at said well at a location spaced apart from any one of said ribs.

2. The lap tray of claim 1 wherein said platen has a substantially rectangular shape, and further includes:

a front edge having a first horizontally recessed zone in a central portion thereof; and a back edge having a second horizontally recessed zone in a central portion thereof.

3. The lap tray of claim 2 wherein said first zone is dimensioned to accommodate an arc portion of a steering wheel of approximately 60 degrees.

4. The lap tray of claim 2 wherein said second zone defines an arcuate segment of approximately 45 degrees and a radius of approximately 17 centimeters (6.7 inches).

5. The lap tray of claim 1 which further comprises a pair of fins projecting downwardly from said undersurface and extending radially from said wall, said fins being separated by an arc of approximately 90 degrees.

6. The lap tray of claim 5 wherein said fins are shaped and dimensioned to provide resting surfaces for the thumb and index finger of a person carrying said tray by said well.

7. The lap tray of claim 1 wherein said well has an outer wall defining a series of frustoconical rings of progressively decreasing radii.

8. The lap tray of claim 1 which further comprises a circular flange extending downwardly from said bottom.

9. The lap tray of claim 1 wherein said platen further has a pair of shallow depressions astride said area.

10. The lap tray of claim 1 wherein said platen further has a utensil holder.

11. The lap tray of claim 1 wherein said platen further has at least one strap anchorment.

* * * * *